United States Patent [19]

Frost et al.

[11] 3,933,105

[45] *Jan. 20, 1976

[54] SHIRT FRONT ASSEMBLY, METHOD AND APPARATUS

[76] Inventors: Wade W. Frost, Vidalia, Ga. 30474; William C. Sandlin, 708 1st National Bank, Waco, Tex. 76701

[ * ] Notice: The portion of the term of this patent subsequent to Mar. 18, 1992, has been disclaimed.

[22] Filed: Dec. 16, 1974

[21] Appl. No.: 532,960

Related U.S. Application Data

[60] Continuation-in-part of Ser. No. 467,052, May 6, 1974, which is a continuation-in-part of Ser. No. 391,645, Aug. 27, 1973, Pat. No. 3,871,309, which is a division of Ser. No. 243,753, April 13, 1972, Pat. No. 3,780,682, which is a continuation-in-part of Ser. No. 79,031, Oct. 8, 1970, Pat. No. 3,675,604.

[52] U.S. Cl. ..... 112/121.29; 112/121.15

[51] Int. Cl.[2] ..... D05B 19/00

[58] Field of Search ..... 121/121.29, 121.15, 10, 121/130, 121.11, 2

[56] References Cited

UNITED STATES PATENTS

| | | | |
|---|---|---|---|
| 2,313,433 | 3/1943 | Golden | 112/10 X |
| 2,685,664 | 8/1954 | Visconti | 112/130 X |
| 2,940,404 | 6/1960 | Damon | 112/10 |
| 3,097,618 | 7/1963 | Davis | 112/10 X |
| 3,223,059 | 12/1965 | Jacobs | 112/130 X |
| 3,295,483 | 1/1967 | Rothfuss et al. | 112/121.15 |
| 3,355,163 | 11/1967 | Southwell et al. | 112/121.29 X |
| 3,413,942 | 12/1968 | Scholl | 112/121.15 |
| 3,476,003 | 11/1969 | Adams | 112/130 X |
| 3,661,106 | 5/1972 | Huddelston | 112/130 X |
| 3,854,430 | 12/1974 | Bryan | 112/130 X |
| 3,871,309 | 3/1975 | Frost | 112/121.29 |

*Primary Examiner*—Alfred R. Guest

[57] ABSTRACT

A system of manufacturing shirt front assemblies is disclosed wherein a connected series of center plait pattern parts and a series of shirt front pattern parts are fed simultaneously to a sewing machine and sewn together to form a connected series of shirt front assemblies. The connected series of shirt front assemblies are conveyed away from the sewing station through a buffering system to a cutting station where the center plait pattern parts are cut apart and trimmed so as to have their ends coextensive with the edges of the shirt front pattern parts, and the cut-apart series of shirt front assemblies are stacked.

3 Claims, 5 Drawing Figures

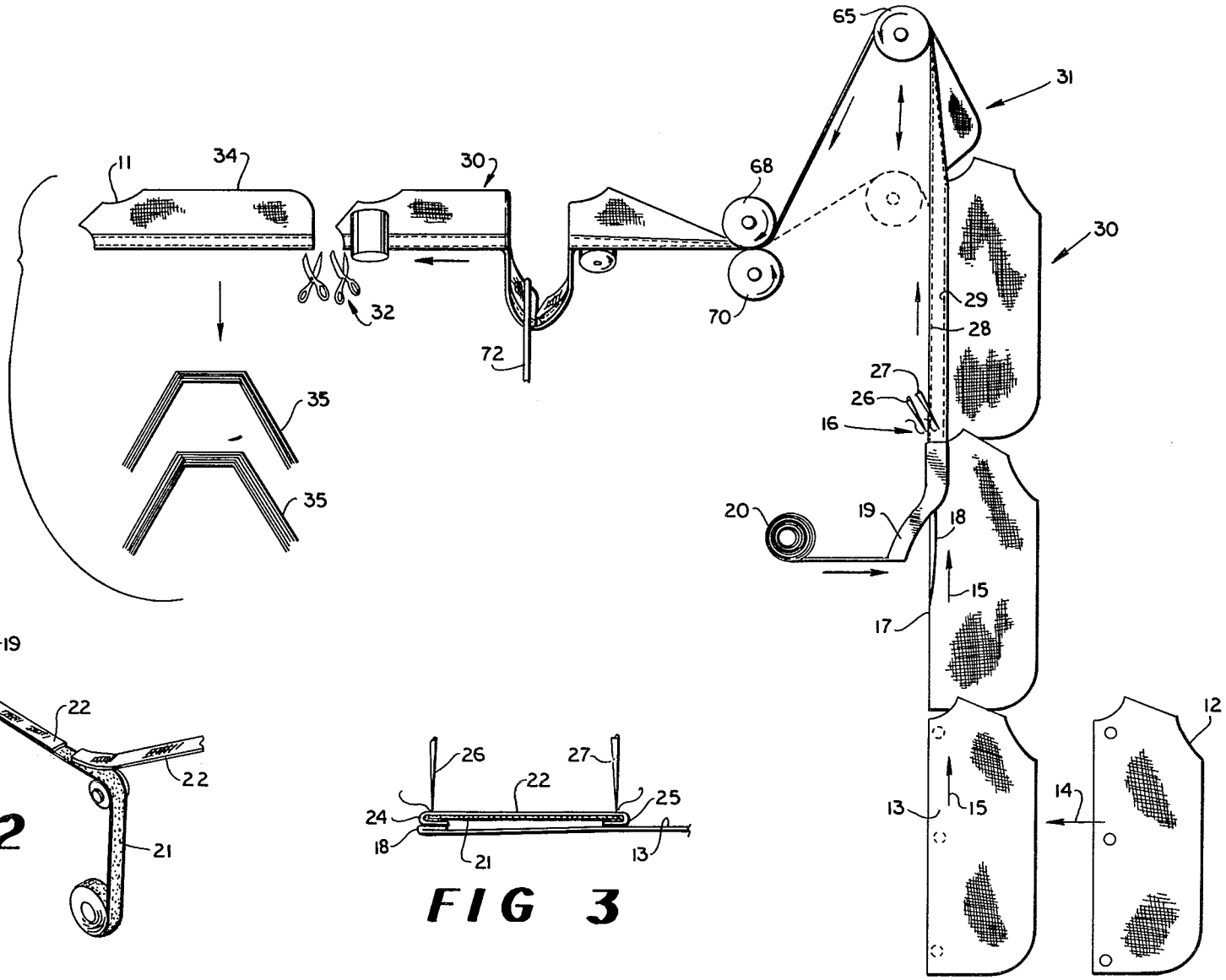
FIG 1
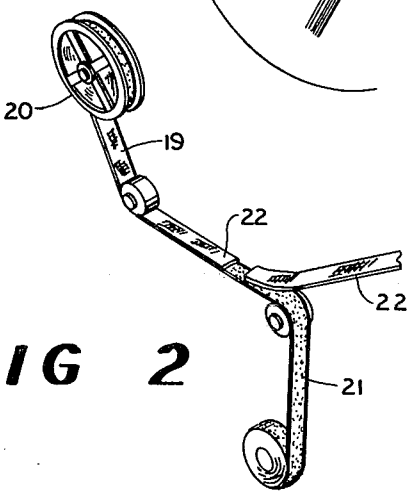
FIG 2
FIG 3

SHIRT FRONT ASSEMBLY, METHOD AND APPARATUS

CROSS REFERENCE TO RELATED APPLICATION

This application is a continuation of application Ser. No. 467,052, filed May 6, 1974 entitled "SHIRT FRONT ASSEMBLY, METHOD AND APPARATUS", which application is a continuation-in-part of application Ser. No. 391,645, filed Aug. 27, 1973 entitled "SHIRT FRONT ASSEMBLY, METHOD AND APPARATUS", now U.S. Pat. No. 3,871,309 issued Mar. 18, 1975; which application is a division of application Ser. No. 243,753, filed Apr. 13, 1972, entitled "SHIRT FRONT ASSEMBLY METHOD AND APPARATUS", now U.S. Pat. No. 3,780,682, issued Dec. 25, 1973; which application is a continuation-in-part of application Ser. No. 79,031, filed Oct. 8, 1970, entitled "GARMENT CUTTING AND STACKING METHOD", now U.S. Pat. No. 3,675,604, issued July 11, 1972.

BACKGROUND OF THE INVENTION

When the center plait or buttonhole strip of a garment, such as a man's shirt or a woman's dress, is connected to the shirt front pattern part, the center plait pattern part is usually folded under along its side edges and its ends are placed in overlying relationship with respect to the shirt front pattern part. When the center plait is sewn to the shirt front pattern part to form the shirt front assembly, the ends of the center plait extend beyond the top and bottom edges of the shirt front pattern part. In the past, after the center plait had been attached to the shirt front pattern part to form the shirt front assembly, a bundle of shirt front assemblies was allowed to collect at the sewing station and another worker transferred the bundle to another station where the ends of the center plait of each assembly were trimmed by a third worker so that the cut ends of each center plait were approximately even or coextensive with the edges of the shirt front pattern part. The upper end of the center plait, usually the leading end as the pieces are processed through the sewing machine, were cut with a curved cut or an angled cut to match the neck opening of the garment, while the lower or trailing end of the center plait was cut with a straight cut that matched the lower edge or tail of the garment.

In order to fabricate the shirt front assemblies it was necessary to first attach the center plait to the shirt front panel, stack the shirt front assemblies in a bundle at the sewing station, transfer the bundles to a cutting station cut the ends of each center plait, restack the shirt front assemblies, and transfer the cut bundle to a subsequent work station where subsequent stitching and other garment fabricating functions were performed. The manual steps of sewing, stacking, transferring, cutting and restacking the garment parts in the process of applying the center plaits to the garment panels is onerous, expensive, and there is some likelihood of misplacing bundles of garment parts or individual garment parts in the manufacturing process. Moreover, the more times the shirt fronts are manually handled in the separate sewing and cutting operations, the more likely is the tendency toward non-uniformity in the finished products.

SUMMARY OF THE INVENTION

Briefly described, the present invention comprises a method and apparatus for fabricating shirt front assemblies in a connected series by forming a connected series of center plait pattern parts and connecting the shirt front pattern parts to the series of center plait pattern parts. The resulting connected series of shirt front assemblies is conveyed away from the sewing station by conveying the connected series of center plait pattern parts with the shirt front pattern parts hanging from the center plait pattern parts. The connected series of shirt front assemblies is conveyed through a buffering system to a cutting station where the connected series is intermittently fed to a cutter and the connected series of shirt front assemblies is cut apart and the individual shirt front assemblies are stacked. A conveyor assembly located between the sewing station and the cutting station functions as the buffer between the sewing station and the cutting station so that the speed of operation at the sewing station normally is independent of the speed of operation at the cutting station, and the cutting function at the cutting station is terminated when the supply of connected series of shirt front assemblies is low. The shirt front pattern parts are automatically fed from a stack of pattern parts to the sewing station and folded as they approach the needles in the sewing station. In a similar manner, the series of center plait pattern parts is guided from a supply toward the sewing station and folded as they approach the needles and the movements of the center plait pattern parts and shirt front pattern parts toward the sewing station are regulated so they are sewn together in the proper relationship.

BRIEF DESCRIPTION OF THE DRAWING

FIG. 1 is a schematic illustration of the process of forming shirt front assemblies.

FIG. 2 is a schematic illustration of the method of forming a connected series of center plait pattern parts.

FIG. 3 is a detail illustration of the pattern parts and the manner in which they are sewn together.

DESCRIPTION OF AN EMBODIMENT

Figure 4:
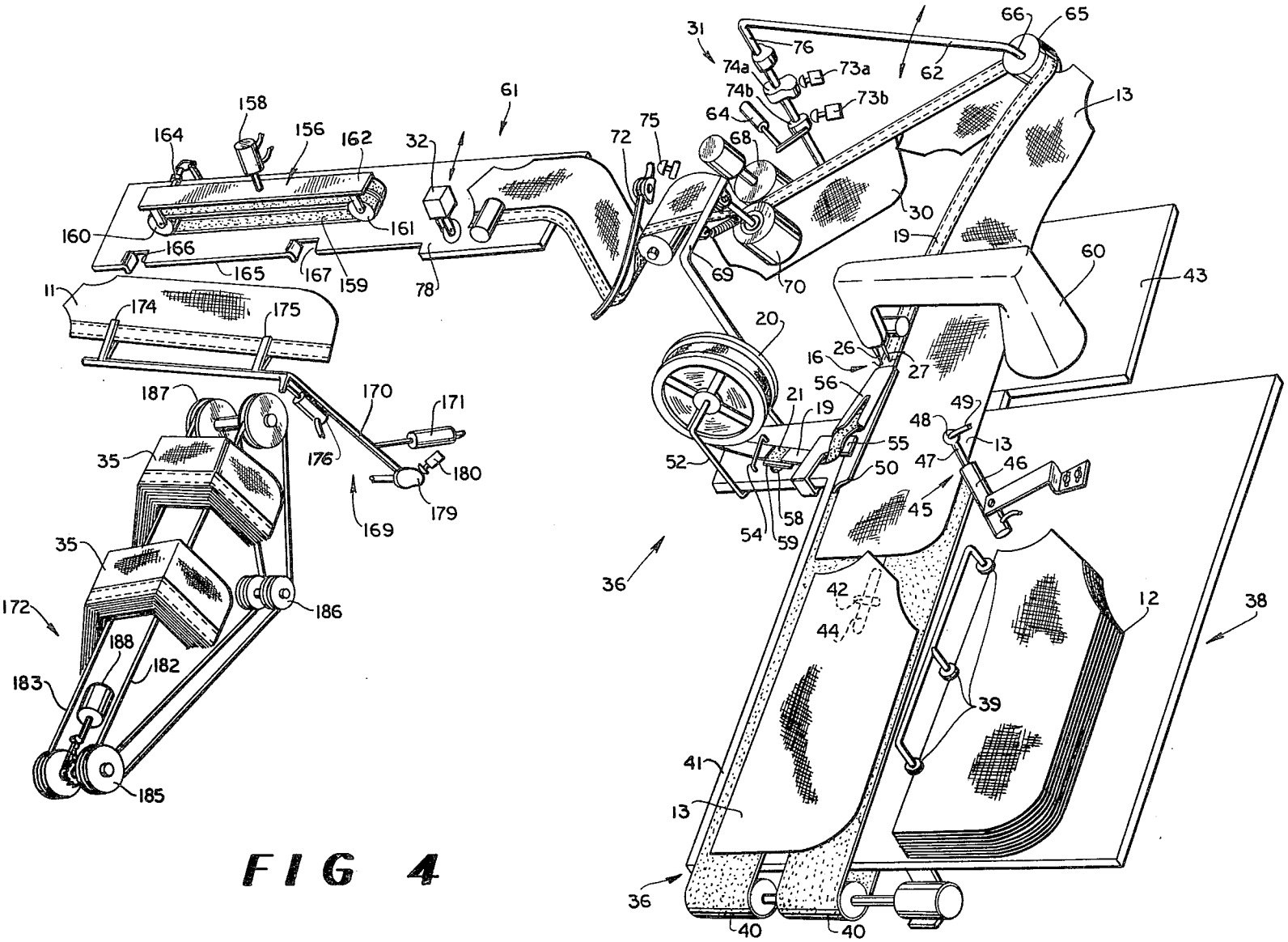
FIG. 4 is a perspective view of the apparatus for forming shirt front assemblies.

Referring now in more detail to the drawing, in which like numerals indicate like parts throughout the several views, FIG. 1 shows a process 10 in which shirt front assemblies 11 are manufactured. A stack of shirt front panels or pattern parts 12 is formed, usually from a bunch of pattern parts received from a cutting area, and the top ply or pattern part 13 is lifted from the stack 12 and moved in the direction indicated by arrow 14 over to a path where the pattern parts are to be conveyed and passed through a sewing station. Each pattern part 13 is moved in the direction indicated by arrow 15 toward a sewing station 16. Sewing station 16 includes a fabric connecting means which functions to connect together layers of fabric, and can include various adhesive, fusing, sewing, or other conventional fabric connecting means. By way of example, sewing machine needles 26 and 27 are illustrated. As each shirt front pattern part 13 moves in the direction indicated by arrow 15, the straight or shirt front edge 17 of the pattern part is folded over as indicated at 18. As the shirt front pattern part approaches the sewing station 16, a connected series of center plaits 19 is fed from a supply 20 to the same sewing station.

As is indicated in FIG. 2, the connected series of center plaits 19 are formed by fusing, sewing or otherwise connecting together a continuous length of center plait lining material 21 and center plait pattern parts 22. The center plait pattern parts 22 are placed in end-to-end relationship along the length of the lining material 21, and after the supply of center plait pattern parts have been connected to the lining material and accumulated in a reel or supply 20, the reel 20 is transferred to the process illustrated in FIG. 1. The center plait pattern parts 22 are usually placed in spaced end-to-end relationship along the length of the lining material; however, the pattern parts 22 can be in abutting relationship, or even in overlapping relationship with respect to the lining material, if desired.

As the connected series of center plait pattern parts 19 approaches sewing station 16, the ends of each center plait pattern part will be moved into overlying relationship with respect to the ends of each shirt front pattern part 13 so that the center plait pattern parts protrude beyond the shirt front pattern parts. In addition, the edges of both the lining material and center plait pattern parts are folded inwardly toward each other as indicated in FIG. 3 to form folds 18, 24 and 25. The needles 26 and 27 form the stitching 28 and 29 along the folded edges of the connected series of center plait pattern parts and through the folds of the mated plies of material so that the shirt front pattern parts become connected to the connected series of center plait pattern parts, thus forming a connected series of shirt front assemblies 30.

After the connected series of shirt front assemblies has been formed at sewing station 16, they are handled by conveying means 31 and passed toward cutting means 32 at a cutting station 61. The connected series of center plaits 19 is handled by the conveying means 31 by orienting the shirt front center plaits in an upwardly extending attitude with the shirt front pattern parts hanging in a downward direction and trailing freely from the center plait pattern parts. The connected series of shirt front assemblies 30 are cut apart by cutting means 32, and each shirt front assembly 34 is stacked in stacks 35 at a stacking station.

As is illustrated in FIG. 4, the apparatus 11 for forming the shirt front assemblies includes a fabric feeder which is schematically illustrated at 38. Fabric feeder 38 is of conventional construction and the details of its construction form no material part of this invention. Fabric feeders of the type suitable for use with the apparatus disclosed herein include Fabri-feed series 10 manufactured by U.S.M. Industrial Machinery, a division of United Shoe Machinery of Boston, Mass. Fabric feeder 38 is arranged to transfer shirt front pattern parts 13 from the stack 12 onto conveyor 36. The fabric feeder applies a suction through the suction heads 39 to the top ply of material in the stack 12, the suction heads lift the top ply away from the stack, moves the top ply laterally over to conveyor 36, and then deposits the fabric on the conveyor. Conveyor 36 includes a pair of belts 40 which are arranged to move across the top surface of a work table 41 toward sewing station 16. A photoelectric cell 42 is positioned beneath the table surface in registration with an elongated slot 44 and is arranged to be repositioned along the slot, as necessary. A source of light (not shown) is located above the table surface 41 and arranged to emit light to the photoelectric cell 42. Photoelectric cell 42 is arranged to control the operation of conveyor 36, as will be explained later.

Feeder assembly 45 is located above the surfaces of work tables 41 and 43 at sewing station 16 and comprises single acting pneumatic ram 46 which is spring-urged to its retracted position. Arm 47 of ram 46 includes a gripping head 48 that communicates through conduit 49 with a source of low pressure air. The operation of feeder assembly 45 is controlled by photoelectric cell 42, which causes the distension and retraction of arm 47 and the suction and release of gripping head 48. Feeder assembly 45 functions to grasp a shirt front pattern part 13 and urge the pattern part into the folder 50 and toward the needles at sewing station 16. The feeder assembly 45 is adjustably connected to work table 41 and is angled so as to move the shirt front pattern part in the proper direction for forming the desired fold and to meet the needles 26 and 27 at the sewing station. The relationship between conveyor 36 and feeder assembly 45 is such that the pattern parts 13 first moving with conveyor 36 are subsequently engaged by feeder assembly 45 and the feeder assembly 45 continues to carry the pattern parts from work table 41 onto work table 43 after the conveyor belt 40 of conveyor 38 begins to move back beneath the work table 41.

The reel 20 of connected series of center plait pattern parts is mounted on a bracket 52 from work table 43, and the portion of the supply of connected series of center plait pattern parts feeding away from the reel is directed beneath U-shaped guide 54 toward angle guide 55 and through folder 56 toward sewing station 16. Photoelectric cell 58 is located beneath work table 46 and is in registration with slot 59 between U-shaped guide 54 and angle guide 55. A source of light (not shown) is located above work table 46 and arranged to emit light toward photoelectric cell 58. The photoelectric cell 58 is arranged to control the operation of sewing machine 60 at sewing station 16.

Photoelectric cells 42 and 58 can be positioned at the needles of sewing machine 60, or a time delay circuit (not shown) can be used with the photoelectric cells and the photoelectric cells can be positioned back along the paths of the pattern parts, as indicated in FIG. 4. Fabric feeder 38 is adjusted to feed the shirt front pattern parts onto conveyor 36 at closely spaced intervals, preferably with the shoulder portion of the pattern part overlapping the tail portion of the preceding pattern part as the pattern parts move along the path 15 of the conveyor toward the sewing station. The photoelectric cell 42 at conveyor 36 is arranged to detect the leading and trailing edges of each shirt front pattern part as the shirt front pattern moves toward the sewing station. In a similar manner, the photoelectric cell 58 is arranged to detect the leading and trailing ends of the center plait pattern parts through the lining material 21 as the connected series of center plait pattern parts progress toward the sewing station. When both photoelectric cells 42 and 58 detect darkness, which indicates that both a shirt front and a center plait are ready at the sewing station, both conveyor 38 and sewing machine 60 operate at normal operating speeds and both pattern parts will be processed through the sewing station and sewn together as illustrated in FIGS. 1, 3 and 4. When the pattern parts have been attached to each other and the photoelectric cells 42 and 58 both detect light, which indicates the absence of the pattern parts at the sewing station, both conveyor 36 and sewing machine 60 will continue to operate at normal operating speeds. Because of the longer length of the center plait pattern parts than the shirt front pattern parts and the spacing of both pattern parts as they approach the sewing station, the photoelectric cell 58 usually will detect darkness or the presence of a center plait pattern part before photoelectric cell 42 detects darkness or the approach of a shirt front pattern part. Sewing machine 60 will begin to stop its sewing function and the feeding of the connected series of center plait pattern parts, thus sewing only onto the leading edge of the next-to-be sewn center plait pattern part and waiting for the approach of a shirt front pattern part. When photoelectric cell 42 detects the presence of the oncoming shirt front pattern part, sewing machine 60 will resume its normal operation to sew together the two pattern parts.

While the preceding operation is considered to be the normal operation of the assembly, there are instances when the spacing between the series of center plait pattern parts is greater than the spacing between the oncoming series of shirt front pattern parts. In this situation photoelectric cell 42 will cause conveyor 36 to begin to stop as sewing machine 60 continues to operate and the oncoming leading edge of the next-to-be sewn center plait pattern part will thus reach the needles of the sewing machine ahead of the oncoming shirt front pattern part. When photoelectric cell 58 detects the leading end of the next-to-be sewn center plait pattern part, the operation of conveyor 36 will resume.

The now-connected series of shirt front assemblies 30 is guided from sewing station 16 by conveying means 31 toward cutting means 32 at cutting station 61. Conveying means 31 includes oscillating arm 62 which is urged by spring means 64 in a counterclockwise direction. A truncated cone 65 is rotatable on the downwardly extending leg 66 of oscillating arm 62, and the connected series of shirt front assemblies 30 is guided about cone 65. The connected series of center plait pattern parts 19 engages cone 65 while the shirt front pattern parts 13 droop in a downward direction. A motor driven roller 68 rotates on stationary support 69, and spring biased roller 70 rotates on stationary support 71 and engages motor driven roller 68. Motor driven roller 68 and spring biased roller 70 are arranged to clamp and drive the connected series of shirt front assemblies from the oscillating cone 65 toward cutting station 32. Oscillating wand 72 is positioned between driving rollers 68 and 70 and cutting means 32. Since cutting means 32 operates intermittently and at a different rate of speed than sewing machine 60, oscillating cone 65 and its related elements function as a first buffering means and accumulates and dissipates the connected series of shirt front assemblies between the sewing station and driving rollers 68 and 70, and oscillating wand 72 and its related elements function as a second buffering means and accumulates and dissipates the connected series of shirt front assemblies between driving rollers 68 and 70 and the cutting station. Switches 73*a* and 73*b* which are actuated by cams 74*a* and 74*b* mounted on the downwardly extending leg of oscillating arm 62 function to indicate the length of the connected series of shirt front assemblies accumulated between sewing station 16 and driving rollers 68 and 70, and switch 75 at the base of wand 72 functions to indicate the length of the connected series of shirt front assemblies accumulated between driving rollers 68 and 70 and cutting means 32, and together the switches 73*a*, 73*b* and 75 control the operation of the elements at cutting station 61.

Figure 5:
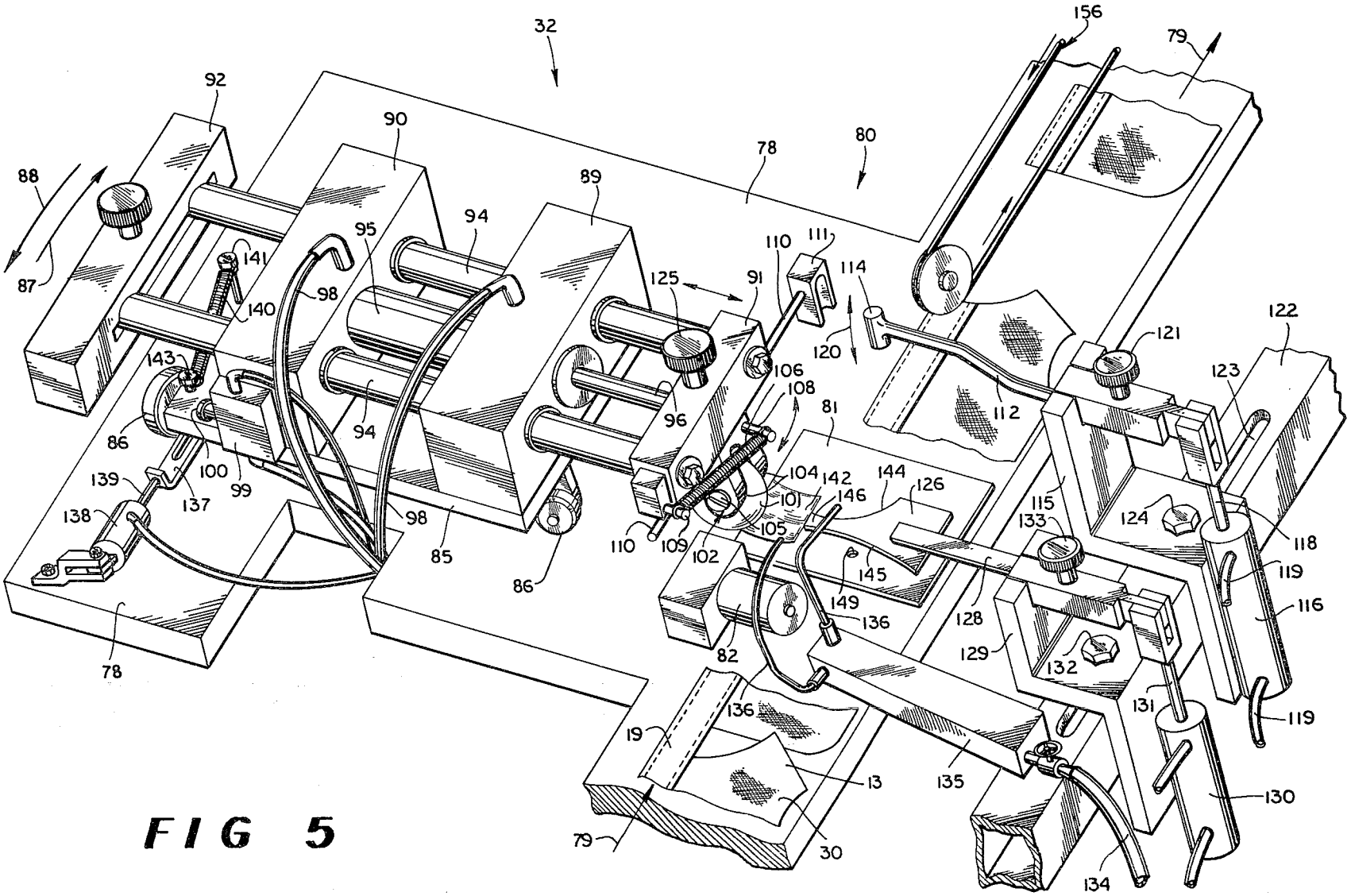
FIG. 5 is a perspective view of the fabric cutter.

While the cutting means 32 at cutting station 61 is schematically illustrated in FIG. 4, FIG. 5 illustrates the cutting means in more detail. Fabric cutter 80 functions as cutting means and includes a work table 78 across which the connected series of shirt front assembly 30 move in the direction as indicated by arrow 79. Bearing plate 81 is formed in work table 78 and is fabricated of hardened metal. Bearing plate 81 is positioned so that the connected series of center plait pattern parts 19 moves across the bearing plate. Feed roller 82 engages the connected series of shirt front assemblies 30 against work table 78 and urges the center plait pattern parts 19 across the bearing plate 81.

Fabric cutter 80 includes movable table 85 supported on work table 78 by a plurality of rollers 86. Movable table 85 is also pivotally supported by work table 78 by a pivot pin (not shown) so that movable table 85 oscillates on work table 78 as indicated by arrows 87 and 88. Bearing blocks 89 and 90 are rigidly mounted on movable table 85, and reciprocatable driving block 91 is positioned forwardly of bearing block 89 while reciprocatable tie block 92 is positioned behind bearing block 90. Tie rods 94 extend through aligned openings in bearing blocks 89 and 90 and are rigidly connected at their ends to reciprocatable driving block 91 and reciprocatable tie block 92. Pneumatic ram 95 has its cylindrical housing mounted in bearing blocks 89 and 90 and its ramrod 96 extends from bearing block 89 and is connected at its end to reciprocatable driving block 91. Ram 95 is a double acting ram, and air under pressure is alternately supplied to opposite ends of the ram through conduits 98. Valve 99 is mounted on one end of bearing block 90, and the valve button 100 is engaged by the end portion of reciprocatable tie block 92. Valve 99 functions to indicate when the reciprocatable driving block 91 has been fully distended by the ram 95, so that pneumatic ram 95 will shift and the driving block will be retracted, as will appear more fully hereinafter.

Disc cutter 101 is positioned over bearing plate 81 and is held by disc cutter support 102. Disc cutter support 102 includes a pair of downwardly extending legs 104, and an axle 105 extends through aligned openings in the legs 104 and through a central opening (not shown) in disc cutter 101. Disc cutter support is mounted on reciprocatable driving block 91 and is pivotal about a vertical axis extending upwardly through the central portion of the disc cutter support 102 and the driving block 91. Coil tension spring 106 has its ends connected to a pin 108 projecting from the surface of disc cutter support 102 and pin 109 extending from reciprocatable driving block 91, so as to continuously urge disc cutter support 102 and disc cutter 101 to their return positions as indicated in FIG. 5, where the disc cutter 101 moves perpendicularly across the connected series of shirt front assemblies 30 as they extend across bearing plate 81.

Pivot control arm 110 is connected to disc cutter support 102 and extends approximately parallel to the longitudinal axis of rotation of axle 105 of disc cutter 101. A socket 111 is mounted on pivot control arm 111. Socket rocker arm 112 includes a rounded protrusion 114 at its distal end for mating with socket 111 of pivot control arm 110. Socket rocker arm 112 is mounted intermediate its ends on support yoke 115, and pneumatic ram 116 has its ramrod 118 connected to the base of rocker arm 112. Pneumatic ram is controlled by pressurized air through conduits 119, and the distension and retraction of ramrod 118 causes socket rocker arm 112 to oscillate in the directions as indicated by arrow 120. Rocker arm 112 can be lengthened or shortened by loosening and retightening set screw 121 and sliding the smaller distal portion of the rocker arm out of or in to its larger base portion. Support yoke 115 can be moved along its supporting framework 122 by loosening and retightening bolt 124 and moving the bolt through its slot 123 in framework 122. Thus, the enlarged protrusion 114 at the end of socket rocker arm 112 can be repositioned across the length of the connected series of shirt front assemblies 30 or repositioned along the length of the connected series of shirt front assemblies 30. In a similar manner, pivot control arm 110 and its socket 111 can be moved through disc cutter support 102 by loosening and retightening clamp bolt 125 protruding from the top surface of reciprocatable driving block 91.

Fabric holding plate 126 functions as a holding means for holding the fabric against bearing plate 81. Fabric holding plate 126 is mounted on the distal end of holding plate rocker arm 128. Rocker arm 128 is supported intermediate its ends by support yoke 129, and its base end is driven by pneumatic ram 130 and its ramrod 131. Support yoke 129 is mounted on framework 122 in the same arrangement as support yoke 115 and can be moved along the length of support frame 122 by loosening and retightening its bolt 132 and the rocker arm can be lengthened or shortened by loosening and retightening set screw 133 and sliding the smaller portion of the rocker arm into or out of the larger base portion. When the ramrod 131 of ram 130 is distended, fabric holding plate 126 is moved downwardly against bearing plate 81 to clamp and hold the fabric in a static position with respect to the bearing plate. When the ramrod 131 is retracted, fabric holding plate 126 will be lifted upwardly away from the bearing plate 81 and allow the connected series of shirt front assemblies 30 to move across the bearing plate 81.

Continuous streams of air are applied to the cutting station by means of air supply conduit 134, air header 135, and air pipes 136. The streams of air tend to urge the fabric on through the cutting station and clear the cut-away portions of the fabric out of the path of the on-coming fabric.

Pneumatic ram 138 is positioned at the rear of movable table 85 and is supported at its base from a stationary support, such as from work table 78, and its ramrod 139 is operatively connected to movable table 85 through slotted bracket 137. Coil tension spring 140 is connected at one of its ends to work table 78 by means of stanchion 141, and at the other of its ends to movable table 85. Coil tension spring 140 tends to rotate movable table 85 in the direction indicated by arrow 87 and hold movable table 85 in the position illustrated in FIG. 5, so that the disc cutter 101 is aimed and will roll directly across bearing plate 81, perpendicularly with respect to the series of shirt front assemblies 30 extending across the work table. When ram 138 causes its ramrod 139 to be retracted, movable table 85 will shift or pivot in the direction indicated by arrow 88 by the slot of slotted bracket 137 pulling against the lower protrusion of pin 143 against the bias of coil tension spring 140. When ram 138 is de-energized, coil tension spring 140 urges movable table 85 to shift back or pivot in the direction indicated by arrow 87. Thus, spring 140 and ram 138 function as shifting means for shifting movable table 85.

Bearing plate 81 has an indentation or recess 142 located beneath disc cutter 101 when the disc cutter has been retracted or moved rearwardly out of the path of the connected series of shirt front assemblies 30. Thus, the disc cutter 101 does not engage the bearing plate 81 until it begins its forward movement across the bearing plate. When the disc cutter 101 is in its retracted position, it can be shifted in the directions indicated by arrows 87 and 88 by ram 138 and spring 140, and the shifting of the disc cutter 101 will not cause it to scrape or bind upon the bearing plate 81.

Fabric holding plate 126 includes a tapered or rounded edge 144 and a relatively straight opposite edge 145. The narrowed end 146 of holding plate 126 is positioned adjacent the indentation 142 in bearing plate 81. When disc cutter 101 is shifted by coil tension spring 140 in the direction indicated by arrow 87, disc cutter 101 will tend to move adjacent the relatively straight edge 145 of fabric holding plate 126 against bearing plate 181 as the disc cutter moves across the bearing plate. If the disc cutter is shifted by ram 138 in the direction indicated by arrow 88, the disc cutter will be moved slightly beyond curved edge 144 of holding plate 126 at the narrowed end 146 of the holding plate and move on bearing plate 81 along the rounded edge 144 of fabric holding plate 126. The slot of slotted bracket 137 of ram 138 allows the movable table to shift further in the direction of arrow 88 as the disc cutter finds its own track across bearing plate 81 under the guiding influence of pivot control arm 110 and rocker arm 112.

Photoelectric cell 149 is located below bearing plate 81 and is positioned in the path of the connected series of shirt front assemblies 30, beside the connected series of center plait pattern parts 19, so as to detect the movement of the leading and trailing edges of each shirt front panel 13 across the bearing plate. The photoelectric cell 149 is interconnected into the control circuitry (not shown) of the fabric cutter 80 so as to initiate the functions of the several controlling elements of the fabric cutter. The control circuitry includes a time delay which allows the feed roller 82 to continue to operate for a short time interval to allow the portion of the shirt detected by the photoelectric cell to reach the fabric cutter before the feed roller stops and the functions of the system begin. Different time delays are used to position the leading or neck portions of the shirt and the trailing or tail of the shirt.

When photoelectric cell 149 detects darkness, as when the leading or next edge of a shirt panel 13 is moving onto bearing plate 81, the cycle of the fabric cutter begins. At the beginning of the cycle, driving roller 82 terminates its rotation after a short time delay so that the neck opening of the shirt panel 13 is located at the curved edge 144 of fabric holding plate 126. Pneumatic ram 130 causes its ramrod 131 to distend and move fabric holding plate 126 downwardly toward bearing plate 81, thus clamping and holding the center plait pattern part and shirt front panel 13 in the connected series of shirt front assemblies 30 on the bearing plate beneath disc cutter 101. In the meantime, pneumatic ram 116 is controlled so that its socket rocker arm 112 is in its upward position and its protrusion 114 will be in alignment with socket 111 of pivot control arm 110. Also, pneumatic ram 138 is controlled so that